US007011607B2

(12) United States Patent
Kolda et al.

(10) Patent No.: US 7,011,607 B2
(45) Date of Patent: Mar. 14, 2006

(54) VARIABLE MAGNETIC RESISTANCE UNIT FOR AN EXERCISE DEVICE

(75) Inventors: Clint D. Kolda, Cottage Grove, WI (US); Chang Shin Pin, Taipei (TW); Zhu Zhao Hua, Nanjing (CN)

(73) Assignee: Saris Cycling Group, Inc., Madison, WI (US)

( * ) Notice: Subject to any disclaimer, the term of this patent is extended or adjusted under 35 U.S.C. 154(b) by 330 days.

(21) Appl. No.: 10/054,781

(22) Filed: Jan. 23, 2002

(65) Prior Publication Data

US 2003/0158016 A1 Aug. 21, 2003

(51) Int. Cl.
*A63B 69/16* (2006.01)

(52) U.S. Cl. ..... 482/57; 482/61; 482/63

(58) Field of Classification Search ..... 482/51, 482/57–65

See application file for complete search history.

(56) References Cited

U.S. PATENT DOCUMENTS

| | | | |
|---|---|---|---|
| 2,534,133 | A | 12/1950 | Kirkpatrick |
| 4,678,182 | A | 7/1987 | Nakao et al. |
| 4,752,066 | A | 6/1988 | Housayama |
| 4,775,145 | A | 10/1988 | Tsuyama |
| 4,822,032 | A | 4/1989 | Whitmore et al. |
| 4,826,150 | A | 5/1989 | Minoura |
| 4,898,379 | A | 2/1990 | Shiba |
| 4,982,953 | A | 1/1991 | Makishi |
| 4,986,533 | A | 1/1991 | Lo |
| 5,031,900 | A | 7/1991 | Leask |
| 5,031,901 | A | 7/1991 | Saarinen |
| 5,051,638 | A | 9/1991 | Pyles |
| 5,072,930 | A | 12/1991 | Sun |
| 5,094,447 | A | 3/1992 | Wang |
| 5,096,024 | A | 3/1992 | Wu |
| 5,145,480 | A | 9/1992 | Wang |

(Continued)

FOREIGN PATENT DOCUMENTS

| | | |
|---|---|---|
| GB | 765586 | 1/1957 |

*Primary Examiner*—Jerome W. Donnelly
*Assistant Examiner*—Fenn C. Mathew
(74) *Attorney, Agent, or Firm*—Boyle, Fredrickson, Newholm, Stein & Gratz, S.C.

(57) ABSTRACT

An automatically adjusting magnetic resistance unit for an exercise device such as a bicycle trainer, in which the degree of resistance is automatically and non-linearly adjusted in relation to the rotational speed of a rotating member caused by the input of a user. The rotating member may be in the form of a flywheel having a number of supports extending between a hub and a rim. The supports define longitudinal grooves which slidably retain magnets that are biased inwardly toward the hub by biasing members. An electrically conductive member is located adjacent the flywheel. As the flywheel rotates in response to rotation of the bicycle wheel, the magnets interact with the conductive member to establish eddy currents that provide resistance to the rotation of the flywheel. The speed of rotation of the flywheel increases as the speed of rotation of the bicycle wheel increases, and centrifugal forces act on the magnets to cause the magnets to slide outwardly along the grooves in opposition to the bias of the biasing members. The outward movement of the magnets causes outward movement of the eddy current forces, to increase the resistance provided to rotation of the flywheel and the bicycle wheel. The variable resistance due to the increased or decreased rotational speed of the flywheel is smooth, based on the constant interaction of the counteracting forces of the biasing members and the centrifugal forces acting on the magnets.

24 Claims, 8 Drawing Sheets

U.S. PATENT DOCUMENTS 5,178,594 A 1/1993 Wu
5,180,348 A 1/1993 Saarinen
5,195,618 A 3/1993 Wu
5,242,351 A * 9/1993 Berg et al. ..... 482/110
5,247,854 A 9/1993 Wu
5,254,061 A 10/1993 Leask
RE34,479 E 12/1993 Minoura
5,310,392 A 5/1994 Lo
5,324,242 A 6/1994 Lo
5,382,208 A 1/1995 Hu
5,397,285 A 3/1995 Haan et al.
5,437,353 A 8/1995 Wu
5,468,201 A * 11/1995 Minoura ..... 482/61
5,472,392 A 12/1995 Haan et al.
5,522,781 A 6/1996 Minoura
5,569,128 A 10/1996 Dalebout
5,586,624 A 12/1996 Ko et al.
5,628,711 A 5/1997 Boucher
5,656,001 A 8/1997 Baatz
5,685,806 A 11/1997 Yu
5,704,876 A 1/1998 Baatz
5,711,404 A * 1/1998 Lee ..... 188/164
5,728,029 A 3/1998 Minoura
5,830,112 A 11/1998 Wang et al.
5,848,953 A 12/1998 Wei et al.
5,851,165 A * 12/1998 Wei et al. ..... 482/63
5,879,273 A 3/1999 Wei et al.
5,944,638 A 8/1999 Maresh et al.
6,042,517 A 3/2000 Gunther et al.
6,042,518 A 3/2000 Hildebrandt et al.
6,071,215 A 6/2000 Raffo et al.
6,084,325 A 7/2000 Hsu
6,095,953 A 8/2000 Lee et al.
6,146,313 A 11/2000 Whan-Tong et al.
6,162,152 A 12/2000 Kuo
6,234,938 B1 5/2001 Chen
6,244,990 B1 6/2001 Cheng
6,273,845 B1 * 8/2001 Liou ..... 482/63
6,345,703 B1 * 2/2002 Peng ..... 188/164
6,360,855 B1 * 3/2002 Szu-Yin ..... 188/161
6,468,186 B1 * 10/2002 Lay ..... 482/63
6,620,081 B1 * 9/2003 Phillips ..... 482/57
6,729,448 B1 * 5/2004 Takahashi ..... 188/294
6,736,761 B1 * 5/2004 Huang ..... 482/57
6,761,254 B1 7/2004 Mercante
2001/0003110 A1 6/2001 Lay

* cited by examiner

VARIABLE MAGNETIC RESISTANCE UNIT FOR AN EXERCISE DEVICE

FIELD OF THE INVENTION

The present invention relates to exercise devices, and more specifically to a magnetic resistance unit adapted to be used in connection with an exercise device such as a bicycle trainer.

BACKGROUND OF THE INVENTION

A number of resistance-type bicycle training devices have been developed that allow a person to stationarily train on a bicycle. Such bicycle training devices are commonly used indoors when it is not possible to ride the bicycle out of doors. Such bicycle training devices normally include a collapsible frame positionable on a floor and releasably attachable to the rear wheel of the bicycle. The frame supports a resistance unit which engages the rear wheel of the bicycle supported by the frame, to provide resistance to the rotation of the wheel. Therefore, as the person moves the pedals and, consequently, the rear wheel of the bicycle, the rotation of the wheel is opposed by the resistance provided by the resistance unit.

The resistance units utilized with devices of this type take many forms, including units utilizing fluid resistance mechanisms, electric resistance mechanisms and air resistance mechanisms, among others. While each of these types of resistance units provides adequate resistance to the rotation of the wheel in order to simulate outdoor riding, each type of mechanism also has certain drawbacks which limit the ability of the resistance unit to vary the simulated riding conditions.

As a result, many types of resistance devices now include magnetic resistance units which overcome many of the drawbacks associated with other types of resistance units. Certain types of magnetic resistance units normally apply resistance to the rotation of the bicycle wheel by application of eddy current forces to a conductive member which rotates along with a rotatable wheel or flywheel, which rotates along with the bicycle wheel. The eddy current forces result from rotation of the conductive member relative to a set of magnets positioned adjacent the conductive member. By moving the magnets relative to each other, an individual can adjust the flux density created by the magnets thereby the strength of the eddy current forces, to vary the resistance to the rotation of the flywheel. The resistance to the rotation of the flywheel is transmitted to the bicycle wheel, to vary the amount of effort on the part of the person to rotate the bicycle wheel in order to overcome the resistance provided by the magnets. A number of examples of bicycle trainers with magnetic resistance units which operate along these lines include Minoura U.S. Pat. Nos. Re 34,479; 5,468,201; 5,728,029; Lee U.S. Pat. No. 5,711,404; Hu U.S. Pat. No. 5,382,208; and Gunther et al U.S. Pat. No. 6,042,517. In each of these units, a number of magnets are disposed adjacent a conductive component interconnected with a flywheel a. As the flywheel rotates, the magnets establish eddy currents in the conductive member, to resist the rotation of the flywheel. The person can adjust the amount of resistance provided to the flywheel by utilizing a cable connected to an adjustment mechanism disposed within the resistance mechanism, that adjusts the position of the magnets with respect to each other or with respect to the conductive member, to increase or decrease the amount of resistance applied to the rotation of the flywheel.

While magnetic resistance units of this type are useful in providing a variable degree of resistance to a person utilizing a training device including the magnetic resistance unit, the structure of these units requires that the person must actively control the amount of resistance provided by the resistance unit at all times. Thus, if the person wishes to increase or decrease the amount of resistance supplied by the resistance unit while exercising, the person must manually adjust the position of the magnets in the resistance unit to achieve the desired amount of resistance. When exercising on the bicycle, it is highly inconvenient for a person to have to adjust the resistance provided by the resistance unit to achieve the desired level of resistance.

Therefore, it is desirable to develop a magnetic resistance unit for a bicycle trainer that has a simple construction and that automatically adjusts the resistance provided by the resistance unit. It is further desirable to have a magnetic resistance unit that provides progressive adjustment in the level of resistance according to the speed of rotation of the bicycle wheel.

SUMMARY OF THE INVENTION

It is an object of the present invention to provide a magnetic resistance unit for a bicycle training device that provides automatic adjustment of the resistance supplied by the unit to the bicycle.

It is a further object of the invention to provide a magnetic resistance unit that smoothly adjusts the resistance applied to the bicycle by the unit over an infinite number of resistance levels between a minimum resistance level and a maximum resistance level.

It is still another object of the invention to provide a magnetic resistance unit that has a simple and inexpensive construction, and that allows damaged or worn parts of the unit to be easily and inexpensively replaced.

The present invention is a magnetic resistance unit for use with an exercise device such as a bicycle training device, which is adapted to be secured to a frame forming a part of the bicycle training device. The frame is releasably attachable to a bicycle such that the resistance unit contacts the bicycle wheel to provide resistance to the rotation of the wheel. The resistance unit includes a mounting member in the form of a support arm pivotally attached to the frame, and a roller rotatably secured to the support arm at a location spaced from the frame. The roller is fixedly attached to one end of a shaft, and is adapted to be engaged by the bicycle wheel. The shaft extends axially outwardly from the roller and is fixedly attached opposite the roller to a flywheel that is rotatably disposed within a housing fixedly connected to the support arm around the shaft. The housing is formed of a conductive material, such as aluminum, and may include a magnetically attractive portion disposed adjacent the flywheel, that is magnetically attracted to a number of magnets disposed on the flywheel. The magnets are slidably disposed within supports located on the flywheel, and are biased inwardly. When the bicycle wheel rotates the roller, shaft and flywheel, the magnets cooperate with the housing to establish eddy currents on the conductive member, which act on the magnets to resist rotation of the flywheel, and to thereby impart resistance to rotation of the bicycle wheel. When the wheel is rotated at increasingly faster speeds, the magnets slide outwardly by centrifugal force along the supports on the flywheel against the bias, to increase the distance of the magnets from the axis of rotation. As the diameter of the path defined by the magnets increases, the distance of the eddy currents from the axis of rotation increases, which functions to increase resistance to the rotation of the flywheel, thereby increasing the difficulty of rotating the roller and bicycle wheel. As the bicycle wheel, roller and flywheel rotate at slower speeds, the inward bias of the magnets in the flywheel supports functions to move the magnets inwardly along the supports to decrease the diameter of the circular path defined by the magnets, thereby decreasing the resistance applied to the rotation of the bicycle wheel. The flywheel is preferably provided with a number of vanes that function to circulate air through the housing containing the magnets upon rotation of the flywheel, to cool the magnets and the housing. The magnets may be mounted to the flywheel or to a rotating member separate from the flywheel.

Various other features, objects and advantages of the invention will be made apparent from the following detailed description taken together with the drawings.

BRIEF DESCRIPTION OF THE DRAWINGS

The drawings illustrate the best mode currently contemplated of practicing the present invention.

In the drawings.

DETAILED DESCRIPTION OF THE INVENTION

Figure 1:
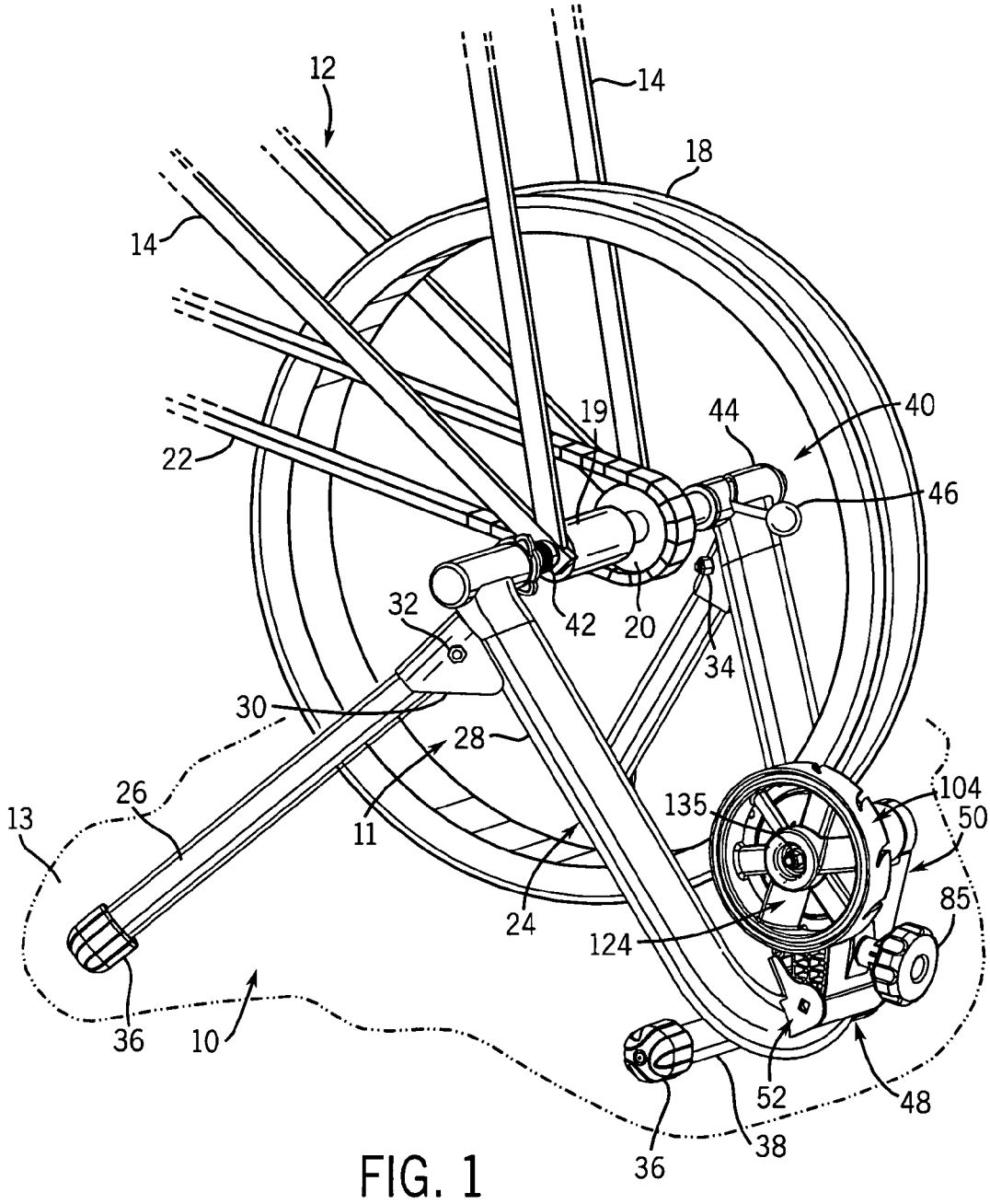
FIG. 1 is an isometric view of a bicycle trainer incorporating the magnetic resistance unit of the present invention, showing a bicycle engaged with the trainer.

With reference now to the drawing figures in which like reference numerals designate like parts throughout the disclosure, a bicycle training device is indicated generally at 10 in FIG. 1. The device 10 includes a frame 11 that is adapted to releasably support a bicycle 12. The frame 11 rests on a horizontal surface 13 and can be a frame similar to that which is incorporated in any conventional bicycle trainer and which is capable of releasably engaging either the frame or a rear wheel of a bicycle, such as is incorporated into trainers manufactured by the Cycle-Ops division of Graber Products, Inc. of Madison, Wis. Bicycle 12 includes downwardly extending frame members or stays 14 that support the hub 19 of a wheel 18 associated with bicycle 12. Hub 19 carries a sprocket 20 driven by a chain 22 in response to a conventional pedal and crank assembly associated with bicycle 10, in a manner as is known The frame 11 has a pair of generally forwardly extending legs 26 attached to opposite ends of a generally U-shaped support member 28. The legs 26 also preferably extend slightly outwardly with respect to the support member 28 to enhance the stability of the device 10. The legs 26 and support member 28 are formed of a generally rigid material, such as a metal tubing, preferably having a circular cross section. Each of the legs 26 is connected to the support member 28 by a brace 30 that is secured to support member 28. A bolt 32 extends through the leg 26 and brace 30, and a nut 34 is engaged with the threads of bolt 32 such that leg 26 is pivotable about bolt 32 between an extended position as shown and a folded position for storage. Opposite the brace 30, each leg 26 also includes a foot 36 formed of a resilient high friction material, such as rubber, that serves to prevent the leg 26 from slipping with respect to the surface 13 on which the frame 11 is positioned. The support member 28 also includes a pair of feet 36 attached to opposite ends of a horizontal cross member 38 secured to the support member 28 opposite the legs 26. The bar 38 serves to assist the legs 26 in holding the device 10 stable and stationary on the horizontal surface 13.

Training device 10 includes a releasable engagement mechanism 40 having a stationary first portion 42 located on one side of frame 11, and a movable second portion 44 having a manual release lever 46 located on the other side of frame 11. In a known manner, one end of the axle of hub 19 is engaged with stationary first portion 42, and lever 46 is operated to engage second portion 44 with the opposite end of the axle. In this manner, the rear of bicycle 12 is engaged with and supported by frame 11 such that rear wheel 18 is above the supporting surface 13, and can thus be rotated by operation of the pedals of bicycle 12.

Figure 2:
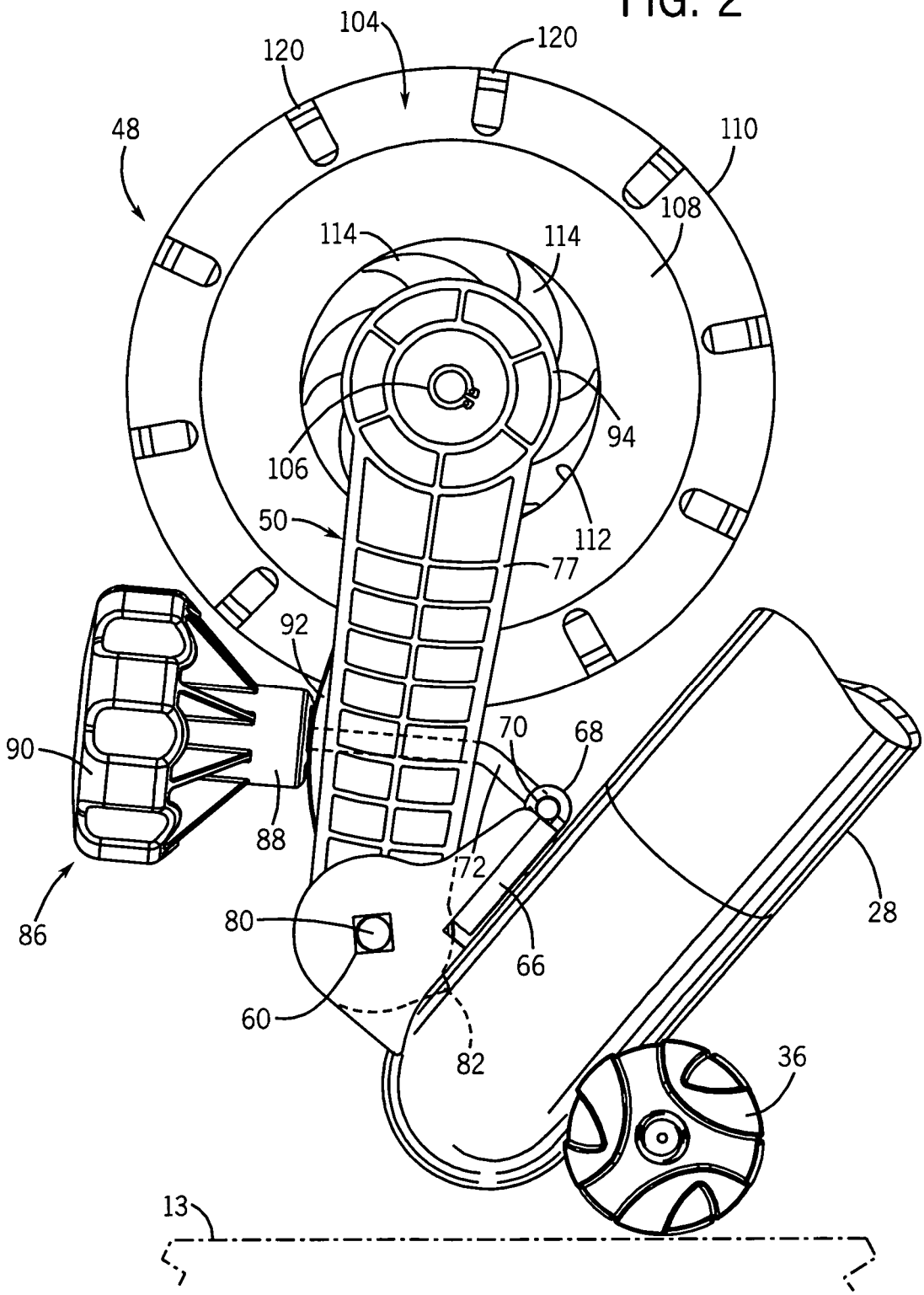
FIG. 2 is a side elevation view of the resistance unit of FIG. 1.
Figure 3:
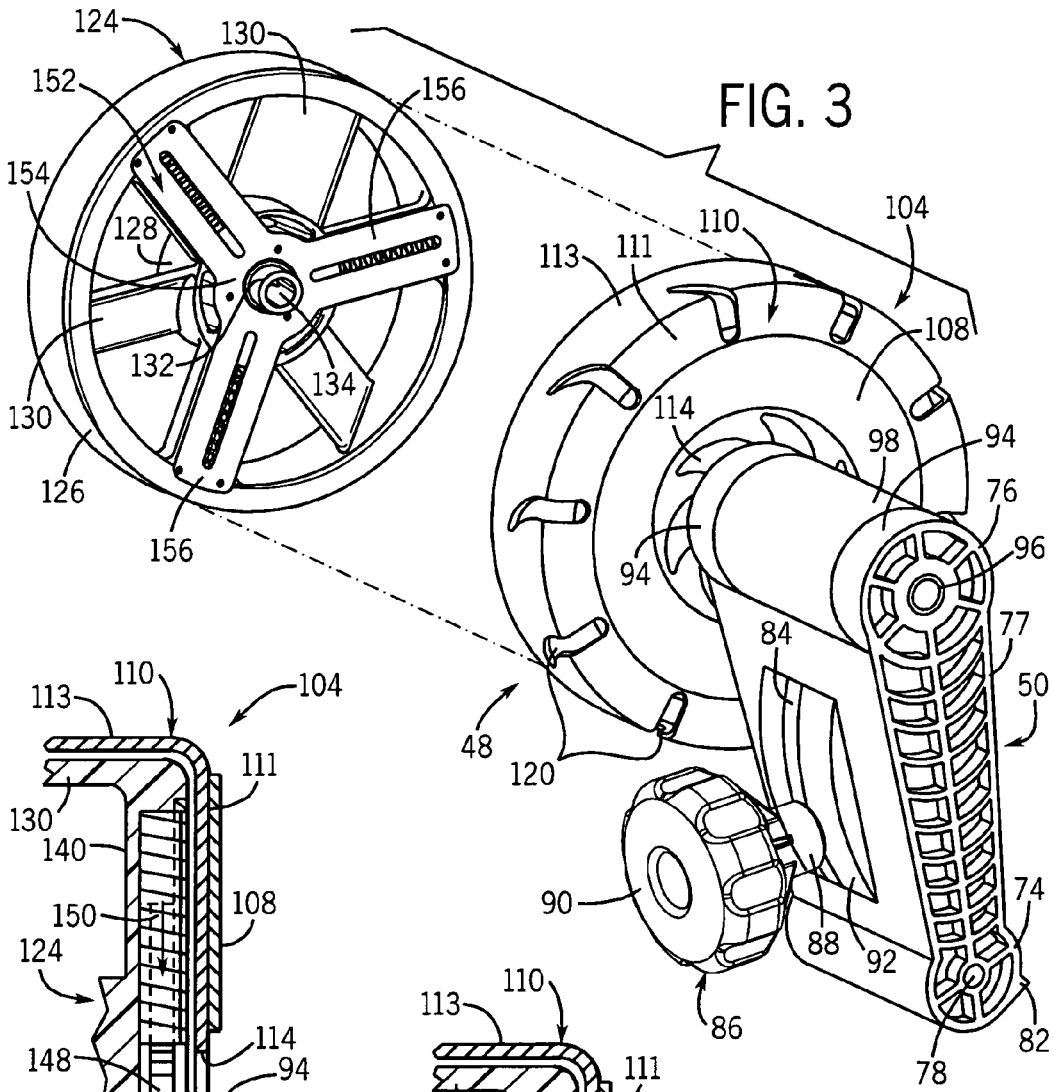
FIG. 3 is a partially exploded isometric view of the resistance unit of FIG. 2.
Figure 7:
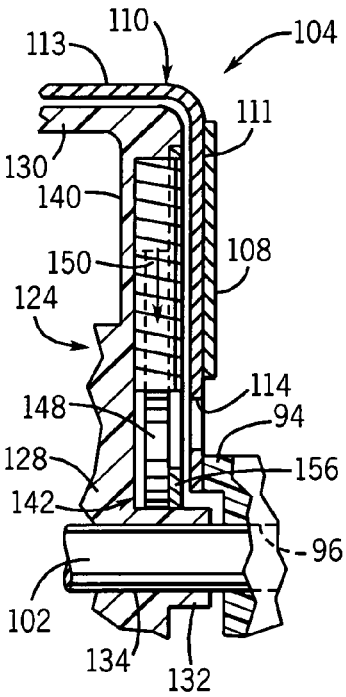
FIG. 7 is a partial section view taken along line 7—7 of FIG. 5.
Figure 8:
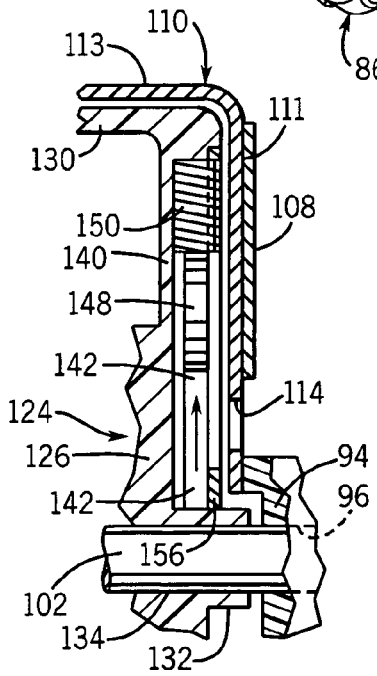
FIG. 8 is a partial sectional view taken along line 8—8 of FIG. 6.

Referring now to FIGS. 1–3, a magnetic resistance unit 48 is movably mounted to frame 11 adjacent cross member 38. The resistance unit 48 includes a support arm 50 pivotally attached to the support member 28 between a pair of mounting members 52. Each mounting member 52 is fixed to the support member 28, and functions to hold the resistance unit 48 on the support member 28. Each mounting member 52 includes an opening 60, and a pivot plate 66 extends between mounting members 52. The pivot plate 66 includes an upwardly curved section 68 that extends outwardly and defines a sleeve 70, which pivotally retains one end of an adjustment rod 72 that is used to adjust the position of the support arm 50 with respect to the support member 28.

The support arm 50 includes a first cylindrical end 74 and a second cylindrical end 76 joined by a generally rectangular section 77. The first cylindrical end 74 defines a channel 78 extending therethrough that is alignable with the opening 60 in each of the mounting members 52. When the channel 78 is aligned with the openings 60, a first shaft 80 can be inserted therethrough to pivotally secure the first end 74 and support arm 50 to the mounting members 52. The first end 74 also includes a protrusion 82 that extends outwardly from the first end 74 and functions to engage the support member 28 or plate 66 and limit the pivoting movement of the support arm 50 with respect to the support member 28.

The generally rectangular center section 77 joining the first end 74 and second end 76 increases in width as it extends from the first end 74 to the second end 76, but can also have a consistent width along its length. The center section 77 includes a central slot 84 extending through the center section 77 perpendicularly to the channel 78 in the first end 74. A threaded end (not shown) of the adjustment rod 72 opposite the sleeve 70 on plate 66 is inserted through the slot 84 and is threadedly engaged with a knob or handle 86. The handle 86 includes a generally cylindrical core 88 with which the adjustment rod 72 is threadedly engaged, and a finger grip portion 90 fixedly secured to the core 88 opposite the adjustment rod 72. The core 88 rests against a pair of curved surgaces 92 extending outwardly from the center section 77 on opposite sides of the slot 84 in order to limit the pivoting of the support arm 50 away from the support arm 28. By rotating handle 86 relative to adjustment rod 72, the position of core 88 on adjustment rod 72 can be adjusted to selectively adjust the angle of support arm 50 with respect to the support member 28. This allows the resistance unit 48 to be adjusted with respect to the support member 28 in order to accommodate wheels 18 having different diameters.

The second cylindrical end 76 is formed by a pair of generally circular flanges 94 extending outwardly from the center section 77 opposite the first end 74. Each of the circular flanges 94 is integrally formed with the center section 77 and includes a central opening 96 extending axially therethrough. A roller 98 is positioned between the flanges 94 and includes a passage 100 within which a shaft 102 is located. Roller 98 is shown as having generally the same diameter as flanges 94, although it is understood that roller 98 may have a diameter either greater or less than that of flanges 94. Shaft 102 is supported by bearings mounted to flanges 94, and extends through the central openings in order to rotatably support roller 98 between the flanges 94. The shaft 102 is fixed to the roller 98 such that the shaft 102 and roller 98 rotate together. The shaft 102 extends outwardly from one of the flanges 94. The shaft 102 can be fixed in position between the flanges 94 to retain the roller 98 rotatably between the flanges 94, by means of a snap ring 106 or other suitable engagement member secured to the shaft 102.

The present invention pertains to the construction and operation of resistance unit 48, which will be described hereafter. The support and mounting components of training device 10 described above are of conventional construction and assembly, and form no part of the present invention.

With reference to FIGS. 2–3 and 7–8, resistance unit 48 includes a flywheel housing 104 located outwardly of one of flanges 94, and the outwardly extending end of shaft 102 extends into flywheel housing 104. Flywheel housing 104 is generally circular in shape and includes an inner ring 108 and an outer cup 110, which defines an internal cavity.

Inner ring 108 is formed of a magnetically attractive material, such as iron or steel. In one embodiment, the material of inner ring 108 may be a steel alloy such as 1018 steel. Inner ring 108 includes an inner edge 112 spaced outwardly of the outer surface of the adjacent circular flange 94. Alternatively, inner ring may be formed so as to extend inwardly a greater amount than is shown, such that its inner edge is located closely adjacent the outer surfaces of flange 94 or simply defines an opening for shaft 102

Outer cup 110 includes a primary wall 111 and an outer peripheral flange 113. Inner ring 108 is connected to primary wall 111 in any satisfactory manner, such as by mechanical fasteners. Primary wall 111 includes a number of generally radially extending spaced apart spiral apertures 114 located inwardly of inner edge 112 of inner ring 108. In a manner to be explained, apertures 114 enable air to pass into or out of the flywheel housing 104.

Outer cup 110 is formed of a conductive material, which may be a metallic material such as aluminum or copper or a non-metallic conductive material such as graphite. In one embodiment, outer cup 110 is formed of an aluminum alloy such as an 1100 series aluminum alloy. Primary wall 111 and flange 113 are preferably integrally formed with one another, although it is understood that flange 113 may be formed separately from primary wall 111 and connected to primary wall 111 in any satisfactory manner. A series of angled openings 120 extend from the primary wall 111 to outer flange 113. The openings 120, along with the spiral apertures 114 allow air into and out of the interior of the housing 104 to cool the moving parts of the resistance unit 48.

Figure 4:
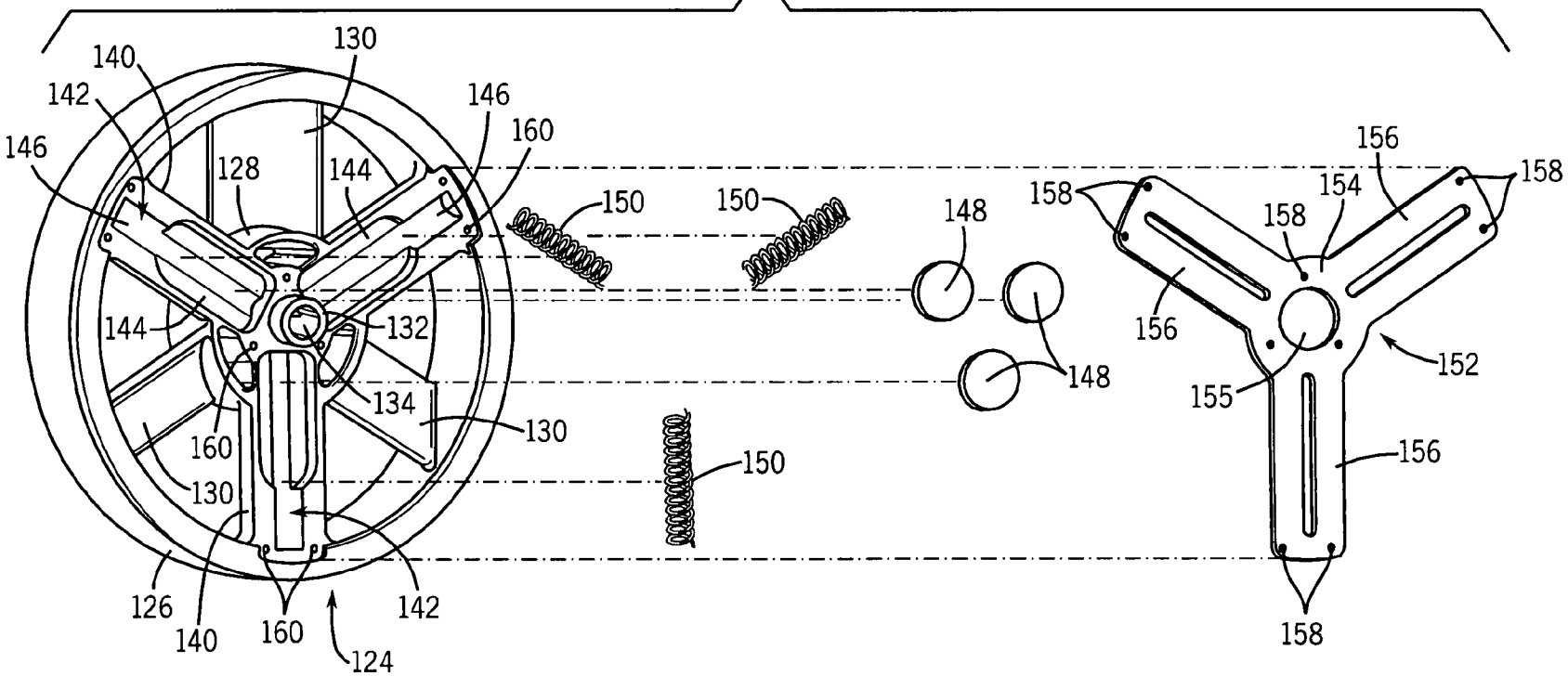
FIG. 4 is an exploded view of a flywheel assembly incorporated into the resistance unit of FIG. 3.
Figure 5:
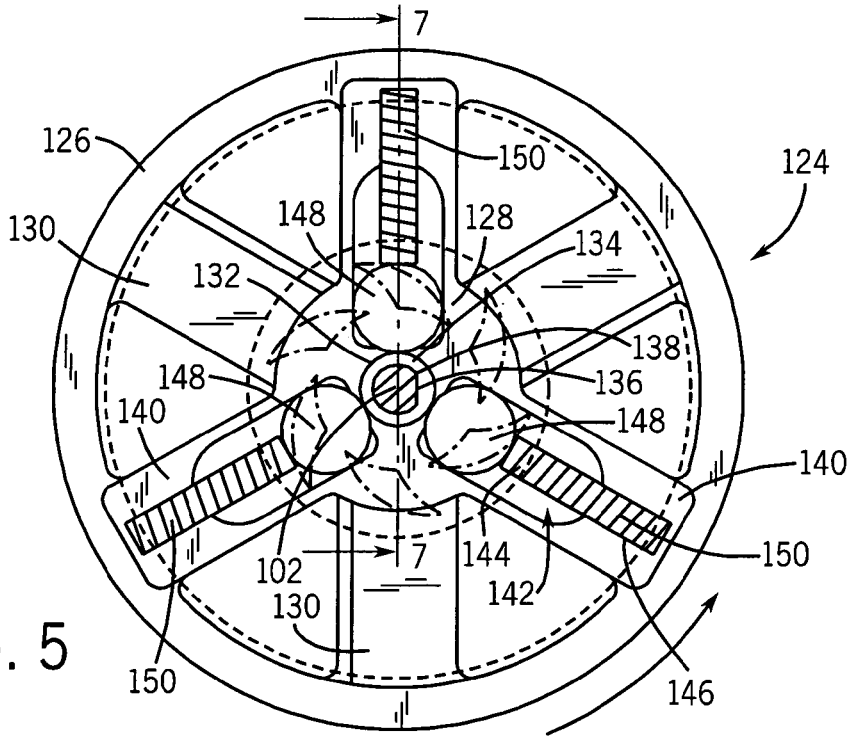
FIG. 5 is a side elevation view of the flywheel assembly of FIGS. 3 and 4, showing the position of magnetic members associated with the flywheel assembly during rotation at low speeds.
Figure 6:
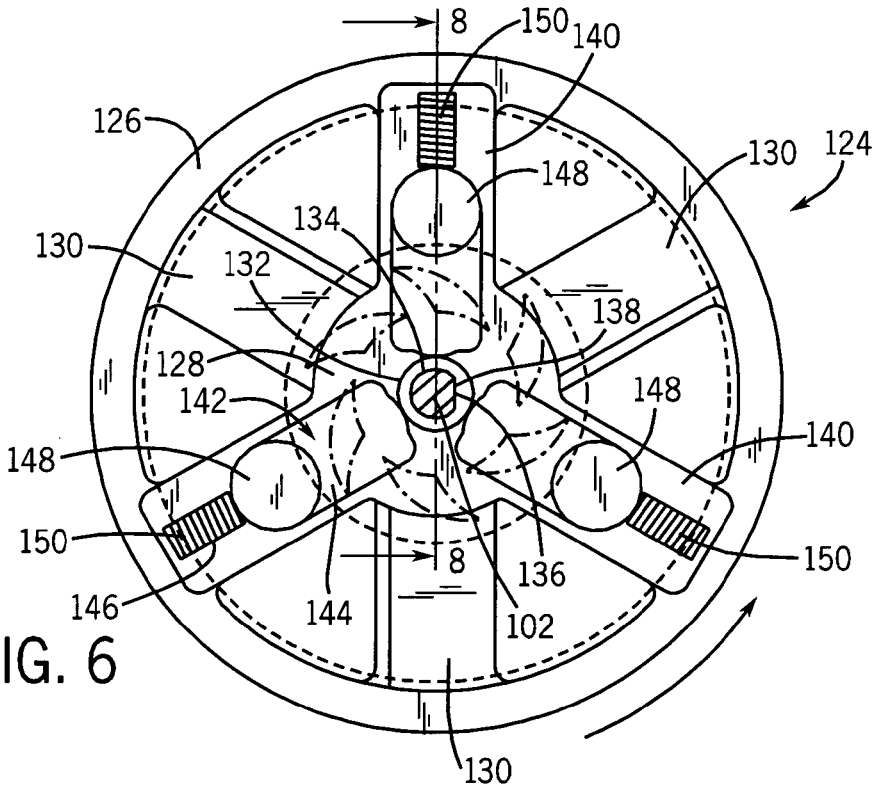
FIG. 6 is a side elevation view similar to FIG. 3, showing the position of magnetic members associated with the flywheel assembly during rotation at higher speeds.

Referring now to FIGS. 1 and 3–4, flange 113 of the outer cup 110 defines an open end 122 opposite primary wall 111 that receives a flywheel 124. The flywheel 124 is generally circular in shape and includes an outer rim 126, an inner hub 128 and a number of angled vanes 130 connecting the outer rim 126 with the hub 128. The flywheel 124 is formed of a rigid non-magnetic metallic material, such as zinc, although it is understood that other materials may be employed. Vanes 130 are preferably spaced equidistant from one another about the interior of the flywheel 124 and are angled with respect to the rim 126 and hub 128 to direct air inwardly toward the housing 104 upon rotation of flywheel 124. The hub 128 includes a central sleeve 132 that extends outwardly from one side of the hub 128 and defines a central opening 134 that passes axially through the center of the hub 128. The sleeve 132 and opening 134 receive the end of the shaft 102 which extends outwardly of flange 94. The flywheel 124 is fixedly mounted to the shaft 102 by a nut 135 or other suitable engagement member, such that the flywheel 124 rotates with the shaft 102. As best shown in FIGS. 5 and 6, to ensure that the flywheel 124 rotates with the shaft 102, the end of the shaft 102 engaged within the opening 134 in the hub 128 includes a flat 136 that is aligned with a similar flattened portion 138 of the opening 134 within the sleeve 132. Alternatively, shaft 102 and flywheel 124 may be interconnected together in any other satisfactory manner, such as by a press fit engagement, etc.

The flywheel 124 also includes a number of supports 140 extending between the outer rim 126 and the inner hub 128 between each pair of adjacent vanes 130. The supports 140 are spaced equidistant from one another and are recessed slightly inwardly from the side of the flywheel 124 positioned adjacent primary wall 111 of outer cup 108. Each support 140 includes a longitudinal groove 142 extending along and facing outwardly from the support 140 towards the inner surface of primary wall 111. Each groove 142 includes a shallow widened portion 144 adjacent the hub 128, and a deeper narrow portion 146 extending throughout widened portion 144 and outwardly toward the outer rim 126. The widened portion 144 receives and retains a disc-shaped magnet 148 that is capable of sliding along the widened portion 144 of the groove 142. Magnet 148 may be formed of any satisfactory magnetic material, such as a rare earth material, although it is understood that other magnetic materials may be employed. A biasing member such as a spring 150 is positioned within the narrow portion 146 of groove 142 outwardly of magnet 148. The outer end of spring 150 engages the end of the narrow portion 146 adjacent the outer rim 126. At its inner end, spring 150 bears against magnet 148. Spring 150 functions to bias magnet 148 inwardly towards the hub 128 to the position shown in FIGS. 5 and 7.

The springs 150 and magnets 148 are retained within the grooves 142 on each support 140 by a retaining plate 152 secured to the flywheel 124 over the grooves 142. The plate 152 includes a circular center portion 154 defining an opening 155 through which extends the central sleeve 132, and a number of arms 156 that extend radially outwardly along each of the supports 140. The center portion 154 can also be omitted such that the plate 152 is formed only of the arms 156 that conform in shape to the configuration of the supports 140. The plate 152 is secured to the hub 128 and supports 140 by appropriate fasteners (not shown) inserted through fastener openings 158 in the plate 152 into aligned bores 160 in the flywheel 124. When secured to the flywheel 124, the plate 152 is flush with the outer edge of the flywheel rim 126, so that the plate 152 does not interfere with the rotation of the flywheel 124 within the housing 104. Further, the plate 152 is formed of a non-magnetic metallic material, so as not to interfere with movement of magnets 148 within grooves 142.

In operation, resistance unit 48 of training device 10 functions as follows to impart resistance to rotation of bicycle wheel 18. With reference to FIGS. 5–8, when an individual operates bicycle 12 to move wheel 18, the wheel 18 causes the roller 98 to rotate. The rotation of the roller 98 consequently rotates the shaft 102, which in turn rotates the flywheel 124 within the housing 104. As the flywheel 124 begins to rotate, magnets 148 are in the inwardmost positions shown FIGS. 5 and 7. Rotation of magnets 148 functions to define a circular path having a small diameter with respect to axis of rotation. In a known manner, the interaction of the magnetic flux of magnets 148 with outer cup 110, upon rotation of magnets 148 by flywheel 148, functions to establish eddy currents in outer cup 110 which act on magnets 148 to resist rotation of flywheel 124. When flywheel 124 is rotated at low speeds, the forces created by such eddy currents are located relatively close to the axis of rotation of flywheel 124, to provide a relatively small amount of resistance to rotation of flywheel 124.

Figure 9:
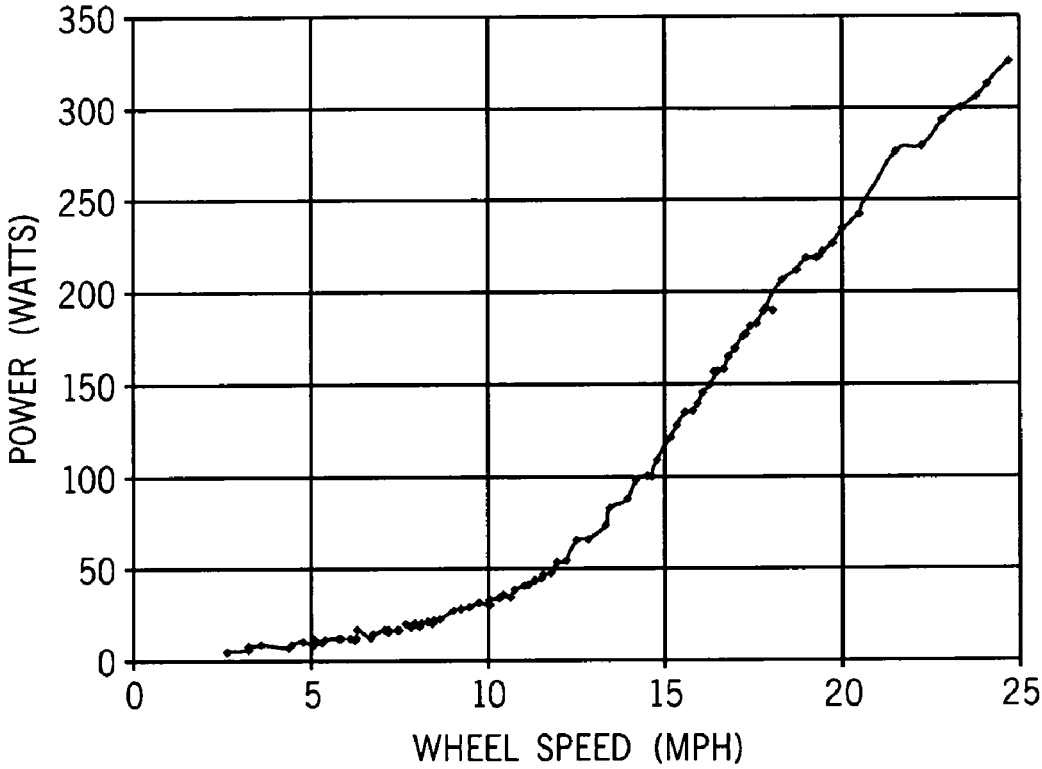
FIG. 9 is a representative power curve attained using the magnetic resistance unit of the present invention.

As the speed of rotation of flywheel 124 increases due to increasing speed of rotation of bicycle wheel 18, magnets 148 are subjected to centrifugal forces which act against the bias of the springs 150, such that magnets 148 slide radially outwardly along the widened portions 144 of grooves 142, to compress the springs 150. The magnets 148 continue to slide along the grooves 142 as the rotational speed of the flywheel 124 increases until the magnets 148 reach the position shown in FIGS. 6 and 8, where the magnets 148 contact the ends of the widened portions 144 of the grooves 142. As magnets 148 are moved outwardly in this manner, the eddy current forces associated with outer cup 110 likewise are moved outwardly from the axis of rotation. This functions to increase the resistance to rotation of flywheel 124, and to thereby increase the resistance to rotation of bicycle wheel 18. The location of magnets 148 between their inwardmost and outwardmost positions is determined by the speed of rotation of flywheel 124 caused by rotation of bicycle wheel 18 such that, at least up to the speed of rotation at which magnets 148 engage the outer end of groove widened portion 144, the resistance to rotation of flywheel 124 is proportional to the speed of rotation of bicycle wheel 18. In this manner, the speed at which the roller 98 and the flywheel 124 are rotated controls the position of the magnets 148 within the grooves 142, which also controls the amount of resistance applied to the roller 98 in opposition to the rotation of the wheel 18. Further, the resistance applied to the wheel 18 transitions smoothly between different amounts of resistance based on the constant interaction of the counteracting forces of the springs 150 and the centrifugal forces acting on the magnets 148, to gradually increase or decrease resistance based on the speed of rotation of bicycle wheel 18. FIG. 9 contains a graphic representation of the power curve attained by resistance unit 48 throughout a conventional range of wheel speed. As shown in FIG. 9, the speed/power relationship is non-linear, such that the power curve is relatively flat at low speeds and becomes steeper as speed increases.

During operation, the presence of inner ring 108 functions to direct the magnetic flux of magnets 148, which increases the efficiency of operation of resistance unit 148, It is understood, however, that resistance unit 148 would function without inner ring 108 by interaction of the rotating magnets 148 with the conductive material of outer cup 110 to establish resistive eddy current forces.

As flywheel 124 rotates within housing 104, vanes 130 function to move air into and through housing 104, and through openings 114 and 120 toward roller 98. This functions to cool housing 104 and the bearings through which shaft 102 extends, to prolong bearing life and to prevent overheating of housing 104.

In operation, the flux density generated by magnets 148 remains constant (although there may be slight variations depending on the degree of overlap with inner ring 108), and resistive forces vary by adjusting the radial position of the magnets 148 relative to the axis of rotation. This is in contrast to most approaches in the prior art, which contemplate adjusting the flux density, e.g. by adjusting the degree of overlap between opposed magnets. Further, the approach contemplated by the present invention provides a progressive adjustment in the degree of resistance based upon speed of rotation. In many prior art designs, adjustment in resistive force is accomplished either manually or in a stepped fashion.

It is possible to vary the amount of resistance that can be generated by the resistance unit 48 by altering the material of inner ring 108 and/or outer cup 110, as well as the strength of the magnets 148 to provide an increase or decrease in the resistive eddy current forces established by rotation of flywheel 124. Also, the resistance generated can be altered by increasing or decreasing the number of supports 140 and magnets 148 disposed on the flywheel 124 to increase or decrease the amount of eddy current forces that must be overcome to rotate the wheel 18. The resistance can also be varied by changing the type of biasing member to an elastomeric member or the like, or changing the size, shape or strength of the spring 150 positioned on each support 140, or by changing the size of the inner disc 108, supports 140 and grooves 142 to provide a wider range between the minimum and maximum amounts of resistance generated by the unit 48. Resistance can also be varied by changing the distance between magnets 148 and the conductive material of outer cup 110.

Figure 10:
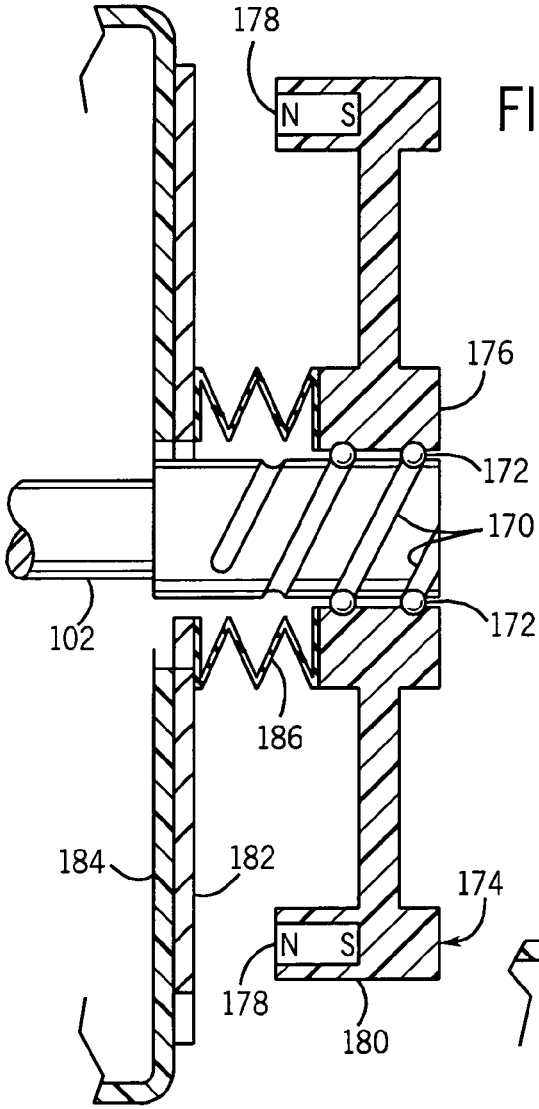
FIGS. 10–12 are schematic cross-sectional views illustrating alternative embodiments of the magnetic resistance unit of the present invention.
Figure 11:
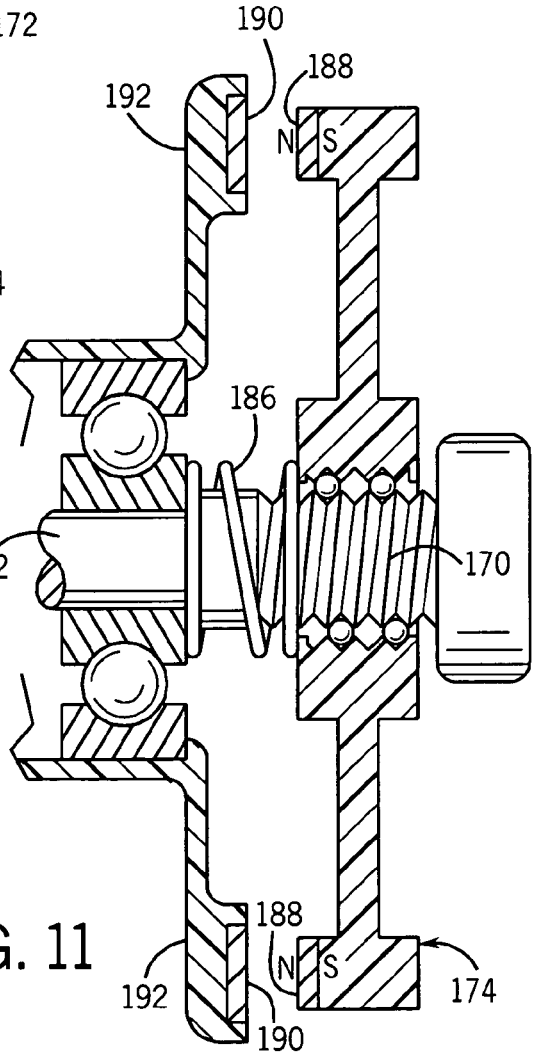
Figure 12:
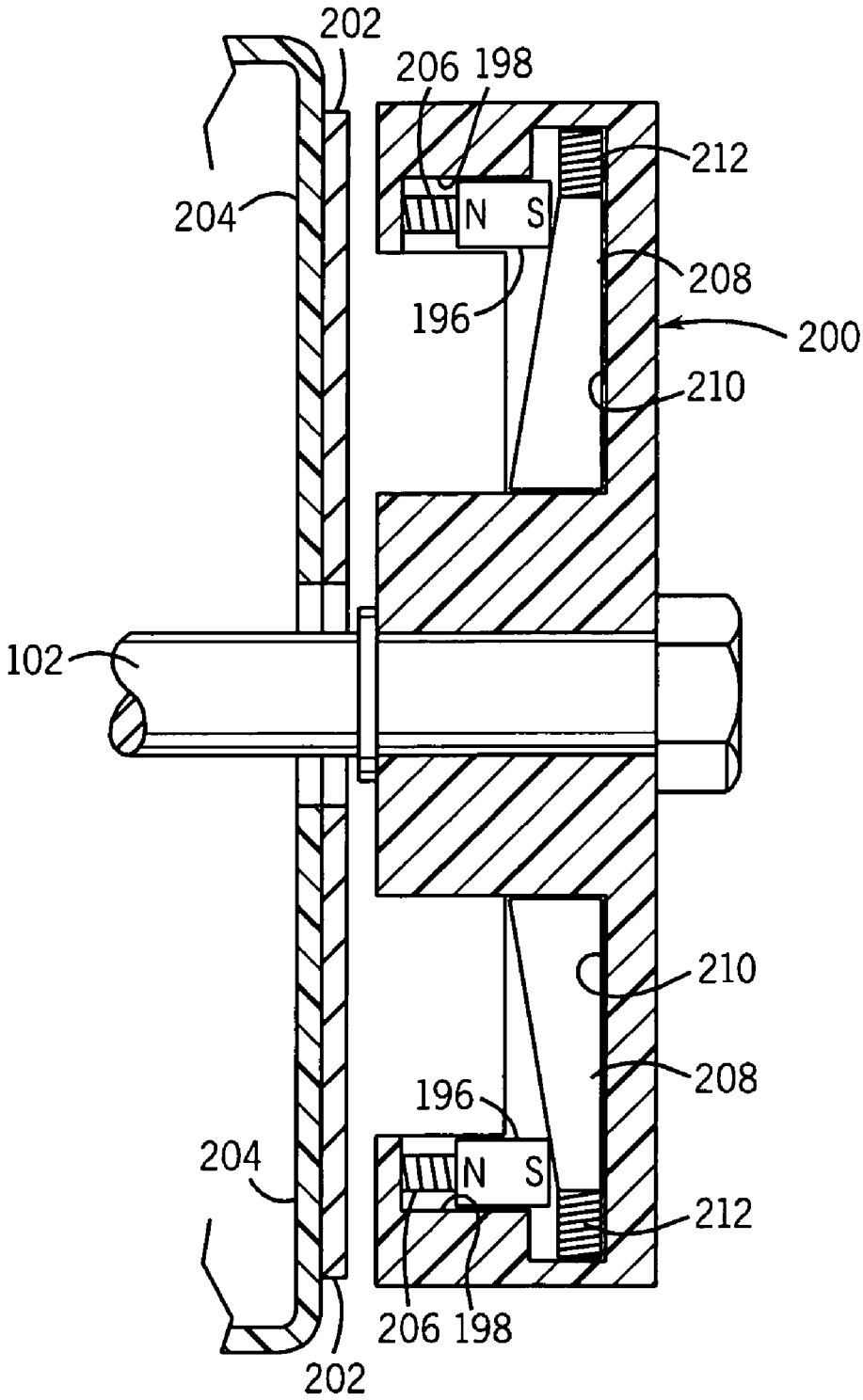

FIGS. 10–13 illustrate alternative embodiments of the magnetic resistance unit of the present invention. As shown in FIG. 10, shaft 102 is provided with a ball screw arrangement, including a set of lead threads 170 and a set of balls 172 engaged with threads 172 and with the flywheel, shown at 174. Balls 172 are mounted to the hub 176 of flywheel 174, and flywheel 174 further includes a set of magnets 178 mounted to an outer peripheral weighted portion 180 of flywheel 174. A stationary electrically conductive member 182 is mounted inwardly of flywheel 174, and a magnetically attractive member 184 is located on the opposite side of conductive member 182, for directing the flux of magnets 178. A spring 186 bears on the inner area of flywheel hub 176 at one end, and may bear against any stationary member, such as the outer surface of conductive member 182, for biasing flywheel 174 away from conductive member by urging balls 172 outwardly in threads 170. In operation, the resistive eddy currents established by rotation of flywheel 174 function to provide a relatively low resistance at low speeds of rotation of flywheel 174 caused by rotation of bicycle wheel 18. As the speed of rotation of flywheel 174 increases, flywheel 174 is moved inwardly toward conductive member 182 by inward movement of balls 172 within threads 174, against the outward bias of spring 186. This results in movement of magnets 178 toward conductive member 182, which increases the strength of the resistive eddy current forces to thereby increase resistance to rotation of flywheel 174 and bicycle wheel 18. As the speed of rotation of flywheel 174 decreases, the force of spring 186 functions to move flywheel 174 outwardly and to decrease resistive eddy current forces as bicycle wheel 18 slows down. FIG. 11 shows a similar arrangement, and like reference characters will be used to facilitate clarity. In this version, a conductive ring 188 is mounted to the outer area of flywheel 174, and a series of stationary magnets 190 are mounted inwardly of flywheel 174, such as to arms 192 associated with the housing of the resistance device.

In the embodiment of FIG. 13, a series of magnets 196 are slidably mounted for transverse movement within a series of passages 198 associated with a rotatable member 200 mounted to shaft 102. The rotatable member 200 may be in the form of a flywheel, or may be any other member mounted to shaft 102. A conductive member 202 is mounted inwardly of rotatable member 200, and a magnetically attractive member 204 may be mounted inwardly of conductive member 202. Magnets 196 are biased outwardly within passages 198 via springs 206, each of which bears between one of magnets 196 and the inner end of its associated passage 198. A wedge 208 engages the outer end of each magnet 196, and is slidable within a radial passage 210 formed in rotatable member 200. Each wedge 208 is biased inwardly under the influence of a spring 212, which bears between the outer in of wedge 208 and the outer end of the wedge passage 210. In this embodiment, springs 206 and 212 function to place each magnet 196 in an outwardmost position at low speeds of rotation. As the speed of rotation increases, wedges 208 are forced outwardly by centrifugal force against the bias of springs 212, to force springs 196 outwardly against the bias of springs 206. This decreases the space between magnets 196 and conductive member 202, to increase the resistive eddy current forces established by rotation of rotatable member 200 and magnets 196 according to the speed of rotation of rotatable member 200. As the speed of rotation decreases, springs 212 function to move wedges 208 inwardly, which results in outward movement of magnets 196 under the influence of springs 206, to decrease the resistive eddy current forces.

While the invention has been shown and described with respect to specific embodiments, it is understood that variations are contemplated as being within the scope of the present invention. For example, and without limitation, it is considered that resistance unit 48 may be used on any type of exercise device such as a stair climber, swim stroke simulator, pedal-type trainer, elliptical trainer, roller-type bicycle trainer, treadmill, etc. As to specific features of resistance unit 48, numerous variations are possible. For example, any type of biasing arrangement may be used for biasing magnets 148 inwardly, and the invention is not limited to the use of springs as shown and described. For example, an elastomeric member or other type of resilient device may be employed. In addition, it is contemplated that use of springs may be replaced with another magnetic member, which is polarized so as to create opposing poles with each magnet 148 to provide a repelling force that biases each magnet 148 inwardly. Magnets 148 may be mounted for sliding movement to any part of flywheel 124, in place of supports 140 as shown and described. Further, while magnets 148 are illustrated as being mounted to flywheel 124, it is also contemplated that magnets 148 may be mounted to a separate rotating member, whether or not a flywheel or other rotating mass is employed. In an embodiment such as this, magnets 148 are mounted in a rotating member made of a material such as plastic, which includes grooves or passages within which magnets 148 are located and in which magnets 148 are inwardly biased and movable outwardly against the biasing force in response to increasing speed of rotation. Further, while housing 104 has been shown and described to include outer flange 113, it is contemplated that flange 113 may be eliminated and primary wall 111 employed on its own.

Various alternatives are contemplated as being within the scope of the following claims particularly pointing out and distinctly claiming the subject matter regarded as the invention.

We claim:

1. A bicycle trainer, comprising:

a frame configured to support a bicycle having a driven wheel; and a resistance device secure as a unit to the frame, wherein the resistance device comprises:

a housing supported by the frame;

a roller rotatably supported by the housing, wherein the roller is arranged engage the driven wheel of the bicycle for rotation in response to rotation of the driven wheel;

a rotatable member rotatably supported by the housing and interconnected with the roller for rotation in response to rotation of the driven wheel, wherein the rotatable member is rotatable about an axis of rotation in response to rotation of the driven wheel;

a stationary electrically conductive member mounted to the housing adjacent the rotatable member; and one or more magnetic members movably mounted to the rotatable member, wherein the magnetic members are movable relative to the stationary electrically conductive member and relative to the axis of rotation in response to variations in the speed of rotation of the rotatable member;

wherein the one or more magnetic members and the electrically conductive member cooperate to form an eddy current force which resists rotation of the rotatable member and thereby resists rotation of the roller and the driven wheel, wherein movement of the one or more magnetic members relative to the stationary electrically conductive member functions to alter the location of the eddy current force relative to the axis of rotation to vary the resistance to rotation of the rotatable member in response to the speed of rotation of the rotatable member caused by rotation of the roller and the driven wheel.

2. The bicycle trainer of claim 1, wherein the rotatable member comprises a flywheel mounted to a shaft which in turn is interconnected with the roller, and wherein the roller is adapted to be engaged by the driven wheel of the bicycle such that the flywheel imparts resistance to rotation of the driven wheel.

3. The bicycle trainer of claim 1, wherein the one or more magnetic members are each located within an open groove associated with the rotatable member, and further including a retainer positioned over the open groove to retain the magnetic member within the groove.

4. The bicycle trainer of claim 3, wherein the magnetic member is slidably retained within the groove.

5. The bicycle trainer of claim 3, further comprising a biasing member positioned within the groove, wherein the biasing member engages the magnetic member to bias the magnetic member radially inwardly.

6. The bicycle trainer of claim 1, wherein the rotatable member includes a plurality of vanes which circulate air upon rotation of the rotatable member.

7. The bicycle trainer of claim 1 wherein the electrically conductive member comprises a primary wall located adjacent a side of the rotatable member and an outer flange located radially outwardly of the rotatable member.

8. The bicycle trainer of claim 1, wherein each magnet is movably mounted to a radially extending support that extends outwardly from a hub section defined by the rotatable member, wherein each magnet is biased inwardly toward the hub section and is moved outwardly against the inward bias by centrifugal force caused by rotation of the rotatable member.

9. The bicycle trainer of claim 1 wherein the rotatable member is formed of a non-magnetic material.

10. The bicycle trainer of claim 9, wherein each magnetic member is positioned within a groove defined by the rotatable member, and is maintained in position on the rotatable member by means of a non-magnetic cover secured to the rotatable member over the groove.

11. The bicycle trainer of claim 1, wherein the one or more magnetic members are mounted to the rotatable member for radially inward and outward movement relative to the axis of rotation in response to variations in the speed of rotation of the rotatable member, and wherein the stationary electrically conductive member includes a radially outwardly extending surface that is axially spaced from the one or more magnetic members, wherein the radially outwardly extending surface of the conductive member lies in a plane that is parallel to the direction of movement of the one or more magnetic members.

12. The bicycle trainer claim 11, wherein the electrically conductive member comprises a disc-shaped member located adjacent the rotatable member.

13. A bicycle training apparatus, comprising:

a) a support frame adapted to support a bicycle having a driven wheel; and b) a resistance unit attached to the support frame, wherein the resistance unit includes a housing, a roller rotatably supported by the housing and engageable with the driven wheel of the bicycle, a shaft extending outwardly from the roller, a stationary electrically conductive member secured to the housing, and a rotatable member attached to the shaft and located adjacent the stationary electrically conductive member, wherein the roller, the shaft and the rotatable member rotate about an axis of rotation, and wherein the rotatable member has at least one radially outwardly movable magnetic element that interacts with the stationary electrically conductive member to establish a resistive eddy current force upon rotation of the rotatable member, wherein the magnetic member is radially movable relative to the axis of rotation in response to the speed of rotation of the rotatable member caused by rotation of the driven wheel of the bicycle to resist rotation of the bicycle wheel.

14. The bicycle training apparatus of claim 13, wherein outward movement of the magnetic element is resisted by a biasing member that engages the magnetic element.

15. The bicycle training apparatus of claim 14 wherein the biasing member is a spring.

16. The bicycle training apparatus of claim 13 wherein the rotatable member comprises a flywheel having a number of vanes to circulate air relative to the conductive member.

17. The bicycle training apparatus of claim 16 wherein the vanes are positioned at an angle with respect to the axis of rotation of the rotatable member.

18. The bicycle training apparatus of claim 13, wherein the radially outwardly movable magnetic element is mounted to the rotatable member for radially inward and outward movement relative to the axis of rotation in response to variations in the speed of rotation of the rotatable member, and wherein the stationary electrically conductive member includes a radially outwardly extending surface that is axially spaced from the magnetic element, wherein the radially outwardly extending surface of the conductive member lies in a plane that is parallel to the direction of movement of the magnetic element.

19. A resistance unit for an exercise device, comprising:

a rotatable member, wherein the rotatable member is rotatable about an axis of rotation;

a disc-shaped electrically conductive member located adjacent the rotatable member;

a magnetically attractive member mounted to the disc-shaped member to direct the magnetic flux of the magnetic member through the disc-shaped member; and one or more magnetic members movably mounted to the rotatable member, wherein the magnetic members are movable relative to the axis of rotation in response to variations in the speed of rotation of the rotatable member;

wherein the one or more magnetic members and the electrically conductive member cooperate to form an eddy current force which resists rotation of the rotatable member, wherein movement of the one or more magnetic members functions to alter the location of the eddy current force relative to the axis of rotation to vary the resistance to rotation of the rotatable member in response to the speed of rotation of the rotatable member.

20. A resistance unit for an exercise device, comprising:

a rotatable member, wherein the rotatable member is rotatable about an axis of rotation;

an electrically conductive member located adjacent the rotatable member; and one or more magnetic members movably mounted to the rotatable member, wherein the magnetic members are movable relative to the axis of rotation in response to variations in the speed of rotation of the rotatable member;

wherein the one or more magnetic members and the electrically conductive member cooperate to form an eddy current force which resists rotation of the rotatable member, wherein movement of the one or more magnetic members functions to alter the location of the eddy current force relative to the axis of rotation to vary the resistance to rotation of the rotatable member in response to the speed of rotation of the rotatable member;

wherein the rotatable member includes a plurality of vanes which circulate air upon rotation of the rotatable member, and wherein the rotatable member is contained within a housing having a plurality of openings to allow circulation of air through the housing upon rotation of the rotatable member.

21. An bicycle trainer, comprising:

a stationary frame configured to support a driven wheel of a bicycle; and a resistance unit mounted to the frame, wherein the resistance unit comprises a housing supported by the frame; a roller rotatably mounted to the housing, wherein the roller is configured to engage the driven wheel of the bicycle for rotation in response to rotation of the driven wheel; a stationary electrically conductive member interconnected with the housing, a rotatable member rotatably mounted to the housing and adapted to rotate in response to rotation of the roller caused by rotation of the driven wheel, and an automatically variable magnetic resistance arrangement carried by the rotatable member which interacts with the stationary electrically conductive member to provide eddy current resistance to the roller through the rotatable member, wherein the automatically variable magnetic resistance arrangement is operable to provide an automatically variable non-linear relationship between the speed of the rotatable member and the resistance provided to the roller in response to the speed of rotation of the rotatable member.

22. The bicycle trainer of claim 1, wherein the automatically variable magnetic resistance arrangement comprises at least one radially movable magnet carried by the rotatable member, and wherein the stationary electrically conductive member includes a radially outwardly extending surface that is axially spaced from the at least one radially movable magnet, wherein the radially outwardly extending surface of the conductive member lies in a plane that is parallel to the direction of movement of the at least one radially movable magnet.

23. An exercise method, comprising the acts of:

providing a bicycle having a driven wheel;

providing a bicycle trainer having a wheel engaging frame assembly and a resistance unit, the resistance unit including housing; a stationary electrically conductive member mounted to the housing, a shaft rotatably mounted to the housing, wherein the shaft is connected to a wheel-engaging roller and to a rotatable member, the rotatable member including at least one support, the at least one support having at least one movable magnetic element located adjacent the stationary electrically conductive member that is urged radially inwardly by a biasing member;

engaging the driven wheel of the bicycle with the wheel engaging frame assembly so that the driven wheel is supported by the frame assembly and the driven wheel of the bicycle contacts the roller;

rotating the driven wheel of the bicycle to rotate the roller, the shaft and the rotatable member about an axis of rotation, wherein the magnetic element interacts with the stationary electrically conductive member to establish an eddy current force that resists rotation of the rotatable member and thereby the bicycle wheel; and varying the radial position of the magnetic element relative to the axis of rotation against the force of the biasing member in response to variations in the speed of rotation of the rotatable member caused by variations in the speed of rotation of the driven wheel of the bicycle, wherein the act of varying the radial position of the magnetic element relative to the stationary electrically conductive member functions to vary the radial position of the eddy current force to vary the degree of resistance to rotation of the rotatable member.

24. The method of claim 23, wherein the stationary electrically conductive member includes a radially outwardly extending surface that is axially spaced from the magnetic element and parallel to the direction of movement of the magnetic element, and wherein the act of varying the radial position of the magnetic element is carried out by varying the radial position of the magnetic element along the radially outwardly extending surface of the electrically conductive member in response to variations in the speed of rotation of the driven wheel of the bicycle.

* * * * *

UNITED STATES PATENT AND TRADEMARK OFFICE

CERTIFICATE OF CORRECTION

PATENT NO. : 7,011,607 B2
DATED : March 14, 2006
INVENTOR(S) : Clint D. Kolda et al.

It is certified that error appears in the above-identified patent and that said Letters Patent is hereby corrected as shown below:

Column 10,
Line 24, delete "secure" and substitute -- secured --;

Column 11,
Line 39, after "trainer" insert -- of --;

Column 13,
Line 24, delete "1" and substitute -- 21 --;
Line 38, after "including" insert -- a --.

Signed and Sealed this

Sixteenth Day of May, 2006

JON W. DUDAS
*Director of the United States Patent and Trademark Office*